US009278249B2

(12) United States Patent
Watterson

(10) Patent No.: US 9,278,249 B2
(45) Date of Patent: Mar. 8, 2016

(54) EXERCISE CYCLE WITH VIBRATION CAPABILITIES

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 146 days.

(21) Appl. No.: 13/950,074

(22) Filed: Jul. 24, 2013

(65) Prior Publication Data

US 2014/0024502 A1 Jan. 23, 2014

Related U.S. Application Data

(63) Continuation-in-part of application No. 13/948,045, filed on Jul. 22, 2013.

(60) Provisional application No. 61/676,486, filed on Jul. 27, 2012, provisional application No. 61/678,066, filed on Jul. 31, 2012, provisional application No. 61/674,483, filed on Jul. 23, 2012.

(51) Int. Cl.

| | |
|---|---|
| ***A63B 22/00*** | (2006.01) |
| ***A63B 71/00*** | (2006.01) |
| ***A63B 22/06*** | (2006.01) |
| ***A63B 69/16*** | (2006.01) |
| ***A63B 21/012*** | (2006.01) |
| ***A63B 21/00*** | (2006.01) |
| *A63B 21/22* | (2006.01) |
| *A63B 24/00* | (2006.01) |

(52) U.S. Cl.

CPC ..... *A63B 22/0605* (2013.01); *A63B 21/00196* (2013.01); *A63B 21/0125* (2013.01); *A63B 22/0046* (2013.01); *A63B 21/225* (2013.01); *A63B 22/0023* (2013.01); *A63B 24/0087* (2013.01)

(58) Field of Classification Search

CPC ..... A63B 22/00; A63B 22/0015; A63B 22/0023; A63B 22/06; A63B 22/06055; A63B 22/08

USPC ..... 482/51, 54, 57–65; 280/274–280, 280/281.1, 282–288

See application file for complete search history.

(56) References Cited

U.S. PATENT DOCUMENTS

| | | | | | |
|---|---|---|---|---|---|
| 3,205,888 | A * | 9/1965 | Stroop | A61H 15/00 | 482/54 |
| 4,917,376 | A * | 4/1990 | Lo | A63B 21/157 | 482/59 |
| 4,925,183 | A * | 5/1990 | Kim | A63B 22/16 | 434/61 |
| 4,958,832 | A * | 9/1990 | Kim | A63B 22/16 | 482/54 |

(Continued)

*Primary Examiner* — Oren Ginsberg
*Assistant Examiner* — Garrett Atkinson
(74) *Attorney, Agent, or Firm* — Holland & Hart LLP

(57) ABSTRACT

An exercise cycle includes a base support and an upright support structure. Connected to the upright support structure are a seat, a handlebar assembly, a pedal assembly, and a resistance assembly. The upright support structure may be pivotally connected to the base support to allow the upright support structure to move between various tilted positions. One or more vibration assemblies may be connected to the exercise cycle at various locations in order to vibrate desired portions of the exercise cycle, such as the handlebar assembly, the seat, or the pedal assembly. The vibrations are transferred to a user during the performance of exercise to provide various physiological benefits to the user.

18 Claims, 6 Drawing Sheets

(56) References Cited

U.S. PATENT DOCUMENTS 5,081,991 A * 1/1992 Chance ..... A01K 15/02 119/700
5,137,501 A 8/1992 Merstedor
5,431,612 A * 7/1995 Holden ..... A63B 21/157 482/54
5,533,951 A * 7/1996 Chang ..... A63B 22/02 198/841
5,709,632 A * 1/1998 Socwell ..... A63B 22/0012 482/51
5,989,161 A * 11/1999 Wang ..... A63B 22/0221 482/51
6,186,290 B1 2/2001 Carlson
6,712,737 B1 * 3/2004 Nusbaum ..... A63B 69/16 482/57
6,918,859 B1 7/2005 Yeh
7,166,067 B2 * 1/2007 Talish ..... A61H 1/001 482/148
7,322,948 B2 1/2008 Talish et al.
7,402,145 B1 * 7/2008 Woggon ..... A61H 1/005 601/49
7,594,878 B1 * 9/2009 Joannou ..... A61H 1/005 482/54
7,682,287 B1 3/2010 Hsieh
7,871,355 B2 1/2011 Yeh
8,002,684 B2 * 8/2011 Laurent ..... A61H 1/005 482/142
8,012,067 B2 * 9/2011 Joannou ..... A61H 1/005 482/54
2002/0142890 A1 10/2002 Ohrt et al.
2003/0073545 A1 * 4/2003 Liu ..... A63B 22/0235 482/54
2004/0067833 A1 * 4/2004 Talish ..... A61H 1/001 482/148
2006/0287161 A1 12/2006 Dalebout et al.
2007/0142183 A1 * 6/2007 Chang ..... A61H 1/001 482/54
2007/0149363 A1 * 6/2007 Wang ..... A63B 22/0235 482/54
2007/0190508 A1 8/2007 Dalton
2007/0270726 A1 * 11/2007 Chou ..... A61H 23/0263 601/70
2007/0298937 A1 * 12/2007 Shah ..... A63B 22/02 482/54
2008/0020907 A1 * 1/2008 Lin ..... A61H 1/005 482/54
2008/0032871 A1 * 2/2008 Yeh ..... A63B 21/0023 482/54
2008/0139370 A1 6/2008 Charnitski
2008/0207407 A1 * 8/2008 Yeh ..... A63B 22/025 482/54
2008/0214971 A1 * 9/2008 Talish ..... A61H 1/005 601/23
2008/0279896 A1 11/2008 Heinen et al.
2009/0053682 A1 2/2009 Stern
2009/0118098 A1 5/2009 Yeh
2009/0221405 A1 * 9/2009 Wang ..... A63B 21/00196 482/54
2009/0221407 A1 9/2009 Hauk et al.
2010/0087298 A1 4/2010 Zaccherini
2010/0184568 A1 * 7/2010 Schippers ..... A61H 1/003 482/51
2010/0210418 A1 8/2010 Park
2010/0311552 A1 * 12/2010 Sumners ..... A61H 23/0263 482/111
2012/0088640 A1 4/2012 Wissink et al.

* cited by examiner

EXERCISE CYCLE WITH VIBRATION CAPABILITIES

CROSS-REFERENCE TO RELATED APPLICATIONS

This application claims priority to U.S. Provisional Patent Application No. 61/676,486 filed on Jul. 25, 2012, U.S. Provisional Patent Application No. 61/678,066 filed on Jul. 31, 2012, and U.S. patent application Ser. No. 13/948,045 filed Jul. 22, 2013 which claims priority to U.S. Provisional Patent Application No. 61/674,483 filed on Jul. 23, 2012.

TECHNICAL FIELD

This disclosure relates generally to systems, methods, and devices for exercise. More particularly, the disclosure relates to an exercise cycle with vibration capabilities.

BACKGROUND

Physical exercise provides exercisers with numerous benefits, including aerobic conditioning, strength enhancement, weight loss, and rehabilitation. These benefits can be realized through various types of exercise, including cycling. Additionally, recent research indicates that vibration therapy can also provide numerous benefits. Such benefits can include improved muscle strength and performance, increased bone density, stamina, flexibility, mobility, and coordination, enhanced critical blood flow throughout the body, relief of aches and pains, enhanced explosive strength, accelerated weight loss, decreased cortisol levels, increased production of serotonin and neurothrophine, and improved injury recovery.

Various devices have been developed to vibrate a person's body in an effort to realize the above noted benefits of vibration therapy. There have also been efforts made to incorporate vibration into more traditional exercise devices. U.S. Pat. No. 3,205,888, U.S. Pat. No. 4,958,832, U.S. Pat. No. 6,918,859, U.S. Pat. No. 7,166,067, U.S. Pat. No. 7,322,948, U.S. Pat. No. 7,871,355, U.S. Patent Publication No. 2007/0190508, U.S. Patent Publication No. 2008/0207407, U.S. Patent Publication No. 2008/0214971, U.S. Patent Publication No. 2008/0279896, U.S. Patent Publication No. 2009/0118098, U.S. Patent Publication No. 2010/0210418, and U.S. Patent Publication No. 2010/0311552 disclose examples of such vibration exercise devices.

SUMMARY OF THE INVENTION

In one example embodiment of the disclosure, an exercise cycle includes a generally upright support structure, a seat mounted on the generally upright support structure, a handlebar assembly mounted on the generally upright support structure, and a pedal assembly connected to the generally upright support structure. Additionally, the exercise cycle includes one or more vibration assemblies that selectively create vibrations to cause at least one of the seat, the handlebar assembly, and the pedal assembly to vibrate.

In another aspect that may be combined with any of the aspects herein, the one or more vibration assemblies comprise a vibration assembly connected to the handlebar assembly.

In another aspect that may be combined with any of the aspects herein, the vibration assembly selectively vibrates the handlebar assembly.

In another aspect that may be combined with any of the aspects herein, the one or more vibration assemblies comprise a vibration assembly connected to the generally upright support structure near the seat.

In another aspect that may be combined with any of the aspects herein, the vibration assembly selectively vibrates the seat.

In another aspect that may be combined with any of the aspects herein, the one or more vibration assemblies comprise a vibration assembly connected to the pedal assembly.

In another aspect that may be combined with any of the aspects herein, the vibration assembly selectively vibrates the pedal assembly.

In another aspect that may be combined with any of the aspects herein, the pedal assembly comprises a pair of cranks and a pair of pedal connected to the pair of cranks In another aspect that may be combined with any of the aspects herein, at least one of the one or more vibration assemblies comprises a motor, a shaft rotatable by the motor about an axis of rotation, and one or more eccentric weights mounted on the shaft.

In another aspect that may be combined with any of the aspects herein, each of the one or more eccentric weights includes a center of mass that is offset from the axis of rotation.

In another aspect that may be combined with any of the aspects herein, rotation of the shaft about the axis of rotation causes the centers of mass of the one or more eccentric weights to revolve around the axis of rotation, thereby creating the vibrations.

In another aspect that may be combined with any of the aspects herein, an intensity or frequency of the vibrations may be selectively controlled by adjusting the speed at which the centers of mass of the one or more eccentric weights revolve around the axis of rotation.

In another aspect that may be combined with any of the aspects herein, the exercise cycle also includes a control panel having one or more user inputs.

In another aspect that may be combined with any of the aspects herein, the control panel is in electrical communication with the one or more vibration assemblies such that the one or more vibration assemblies are controllable by activating the one or more user inputs.

In another aspect that may be combined with any of the aspects herein, an intensity or frequency of the vibrations is related to the speed at which the pedal assembly rotates.

In another aspect that may be combined with any of the aspects herein, the generally upright support structure is selectively movable between a plurality of tilted positions, including a forwardly tilted position, a neutral position, and a rearwardly tilted position.

In another aspect that may be combined with any of the aspects herein, an intensity or frequency of the vibrations is related to a tilted position of the generally upright support structure.

In another aspect that may be combined with any of the aspects herein, the one or more vibration assemblies include a vibration assembly connected to the handlebar assembly, a vibration assembly connected near the seat, and a vibration assembly connected to the pedal assembly.

In another aspect that may be combined with any of the aspects herein, the exercise cycle also includes a resistance assembly operatively connected to the pedal assembly.

In another aspect that may be combined with any of the aspects herein, the resistance assembly regulates the rotation of the pedal assembly.

In another aspect that may be combined with any of the aspects herein, an exercise cycle includes a base support.

In another aspect that may be combined with any of the aspects herein, the generally upright support structure is pivotally connected to the base support.

In another aspect that may be combined with any of the aspects herein, the generally upright support structure is movable between a plurality of tilted positions, including a forwardly tilted position, a neutral position, and a rearwardly tilted position.

In another aspect that may be combined with any of the aspects herein, a control panel is connected to the handlebar assembly.

In another aspect that may be combined with any of the aspects herein, at least one of the one or more vibration assemblies includes a motor, a shaft rotatable by the motor about an axis of rotation, and one or more eccentric weights fixedly mounted on the shaft such that rotation of the shaft causes the one or more eccentric weights to rotate about the axis of rotation.

In another aspect that may be combined with any of the aspects herein, each of the one or more eccentric weights has a center of mass that is radially offset from the axis of rotation.

In another aspect that may be combined with any of the aspects herein, an intensity or frequency of the vibrations created by the one or more vibration assemblies is related to at least one of a rotational speed of the pedal assembly or a tilted position of the generally upright support structure.

In another aspect that may be combined with any of the aspects herein, the one or more vibration assemblies include a first vibration assembly connected to the handlebar assembly and a second vibration assembly connected to the upright support structure near the seat.

In another aspect that may be combined with any of the aspects herein, at least one of the one or more vibration assemblies is connected to the pedal assembly.

In another aspect that may be combined with any of the aspects herein, the exercise cycle includes an extension mechanism connected between the base support and the generally upright support structure.

In another aspect that may be combined with any of the aspects herein, the extension mechanism selectively moves the generally upright support structure between the plurality of tilted positions.

DETAILED DESCRIPTION

Figure 1:
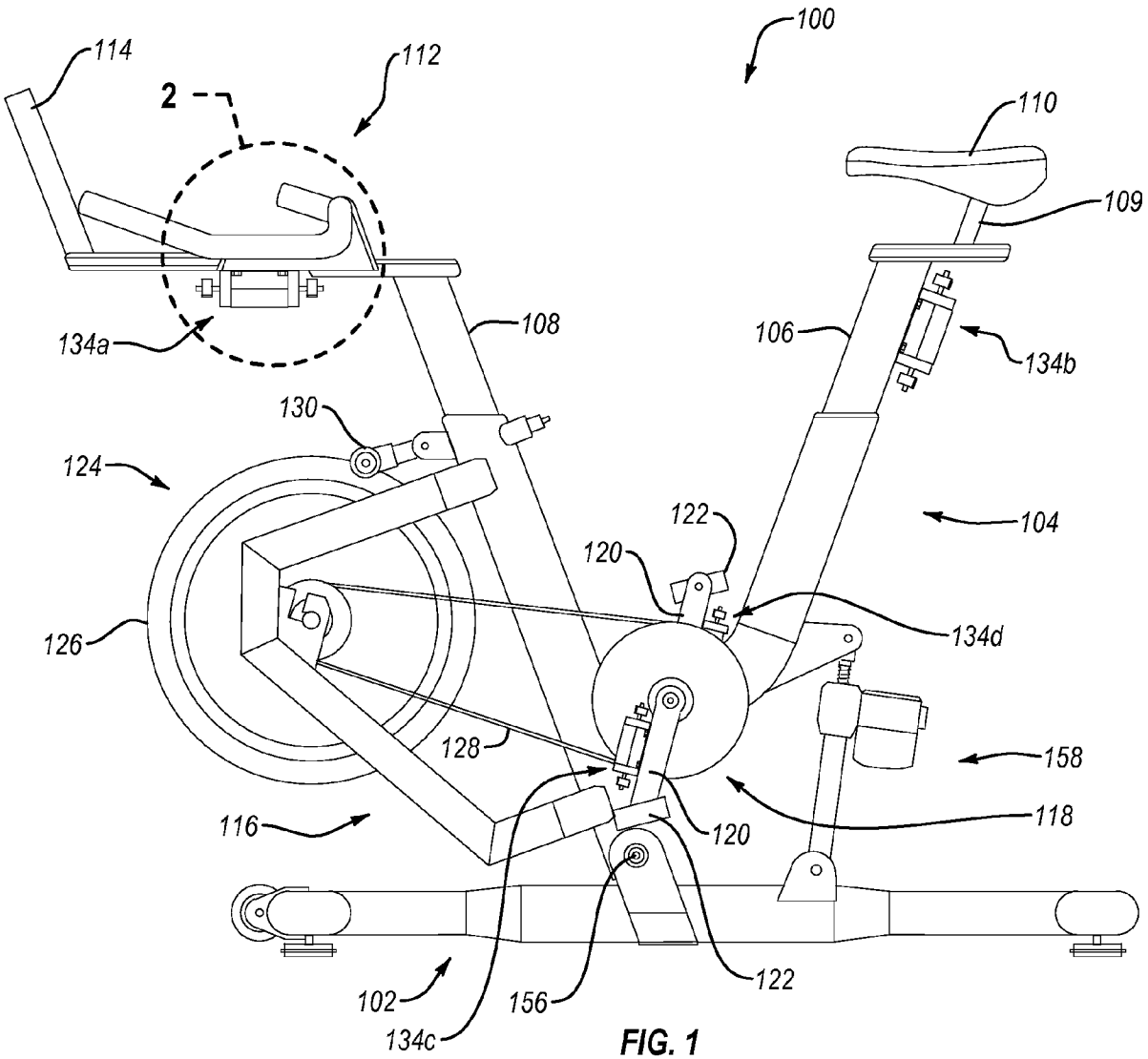
FIG. 1 illustrates a perspective view of an exercise device according to one example embodiment of the present invention.

The present disclosure is directed to systems, methods, and devices for exercise. Depicted in FIG. 1 is a representation of one illustrative exercise device 100, which may incorporate the novel features of the present invention, including various novel devices, functionalities, hardware and software modules, and the like. As shown in FIG. 1, exercise device 100 is depicted as a stationary exercise cycle and includes a base support 102 and a generally upright support structure 104 pivotally connected thereto. Upright support structure 104, in this illustrative embodiment, includes two support members 106, 108. Disposed on an upper end of support member 106 is a post 109 with a seat 110 mounted therein. A user may sit on seat 110 when exercising on exercise device 100. Support member 108 includes a handlebar assembly 112 and a control panel 114.

A drive assembly 116 is mounted on upright support structure 104. Drive assembly 116 includes a rotatable pedal assembly 118 that includes a pair of cranks 120 and pedals 122. Drive assembly 116 also includes a resistance assembly 124 for regulating the rotation of pedal assembly 118. More specifically, resistance assembly 124 includes a flywheel 126 that is operatively connected to pedal assembly 118 by way of a belt or chain 128 such that rotation of pedal assembly 118 causes flywheel 126 to rotate. Additionally, resistance assembly 124 includes a brake 130. Brake 130 may be selectively adjustable in order to adjust a braking force applied to flywheel 126. Increasing or decreasing the braking force on flywheel 126 increases or decreases the resistance to the rotation of pedal assembly 118. As is common with electric exercise cycles, brake 130 may be connected to a controller 130 that controls the operation of brake 130, and thus the resistance applied to pedal assembly 118. The resistance to the rotation of pedal assembly 118 is one example of an adjustable operating parameter of exercise device 100.

Controller 130 can be incorporated within control panel 114, resistance assembly 124, or another portion of exercise device 100. Controller 130 may take the form of a computer, a processor, a microprocessor, a microcontroller, state machine or other similar device that includes circuitry for controlling the operation of one or more features on exercise device 100, including the operating parameter(s) of the movable elements (e.g., cranks 120, pedals 122, flywheel 126, chain 128). Controller 130 may also include one or more computer readable media or devices that have computer executable instructions stored thereon.

Exercise device 100 may also have the capability to vibrate certain portions of exercise device 100. For instance, exercise device 100 may include one or more vibration assemblies 134 connected thereto and which vibrate one or more parts of exercise device 100. In the embodiment illustrated in FIG. 1, for instance, exercise device 100 includes four vibration assemblies 134. More specifically, a vibration assembly **134*a* is connected to handlebar assembly 112, a vibration assembly 134*b* is connected to support member 106, a vibration assembly 134*c* is connected to one of cranks 120, and a vibration assembly 134*d* is connected to the other crank 120**.

When activated, vibration assemblies **134*a*-134*d* may cause all or certain portions of exercise device 100 to vibrate. For instance, vibration assembly 134*a* may cause handlebar assembly 112 to vibrate, which vibrations may be transferred to a user's hands and arms. Similarly, vibration assembly 134*b* may cause support member 106 and seat 110 to vibration, which vibrations may be transferred to the user's trunk. Likewise, vibration assemblies 134*c*, 134*d* may cause cranks 120 and pedals 122 to vibrate, which vibrations may be transferred to the user's feet and legs. Accordingly, vibration assemblies 134*a*-134*d* may vibrate individual parts of exercise device 100. In other embodiments, one or more of vibration assemblies 134*a*-134*d* may vibrate specific areas of exercise device 100. For instance, one or more of vibration assemblies 134*a*-134*d* may vibrate support structure 104 and components mounted thereon (e.g., seat 110, handlebar assembly 112, pedal assembly 118). In still other embodiments, one or more of vibration assemblies 134*a*-134*d* may vibrate the entirety of exercise device 100. Thus, exercise device 100 may include a vibration assembly that vibrates a specific portion of exercise device 100, multiple vibration assemblies that vibrate multiple specific portions of exercise device 100, or one or more vibration assemblies that vibrate all or a substantial portion of exercise device 100**.

Figure 2:
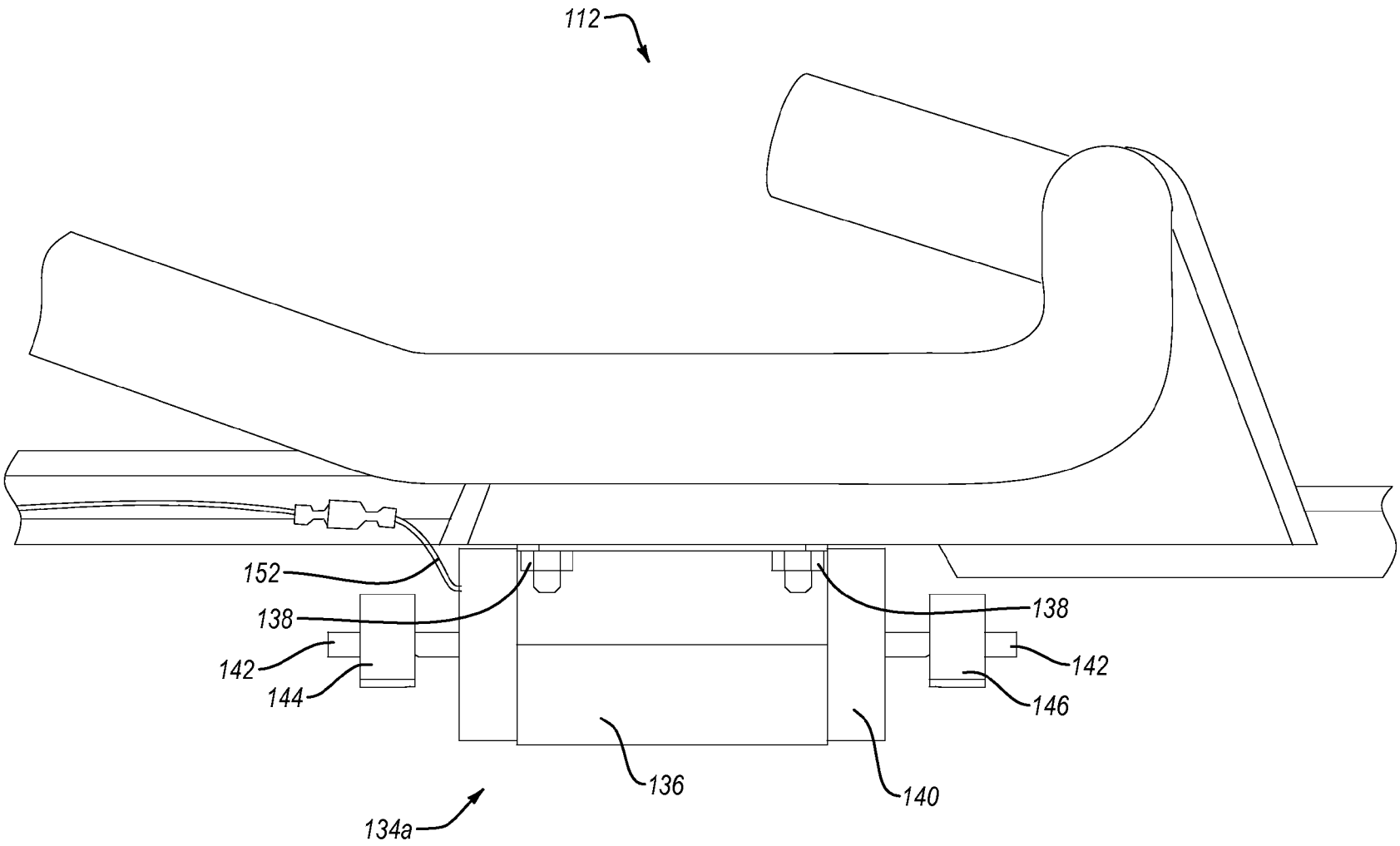
FIG. 2 is a close up view of a vibration assembly connected to the exercise device of FIG. 1.
Figure 3:
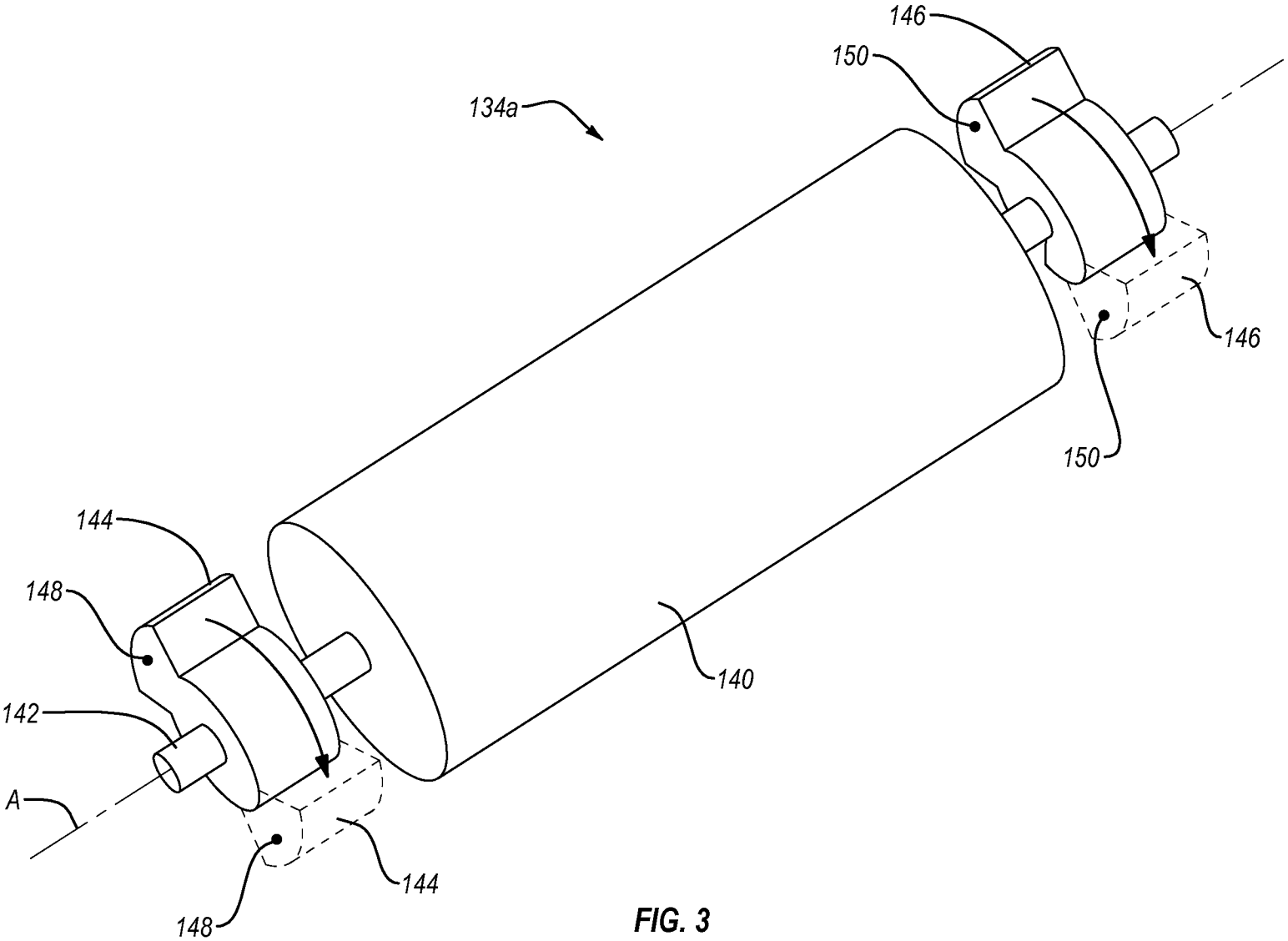
FIG. 3 illustrates the vibration assembly of FIG. 2 separate from exercise device of FIG. 1.

FIGS. 2 and 3 illustrate vibration assembly 134*a* in greater detail. It is understood that vibration assemblies 134*b*-134*d* may be similar or identical to vibration assembly 134*a*. Accordingly, the following discussion of vibration assembly 134*a* is equally applicable to vibration assemblies 134*b*-134*d*. In FIG. 2, a close up view of vibration assembly 134*a* is shown mounted to the underside of handlebar assembly 112. As can be seen in FIG. 2, vibration assembly 134*a* is connected to handlebar assembly 112 with a bracket 136 and bolts 138. In FIG. 3, vibration assembly 134*a* is shown separate from exercise device 100.

According to the illustrated embodiment, vibration assembly 134*a* includes a motor 140, a shaft 142, and eccentric weights 144, 146. Shaft 142 extends through motor 140 such that motor 140 is able to rotate shaft 142 about a longitudinal axis A of shaft 142. Each of eccentric weights 144, 146 has a center of mass that is offset from shaft 142 and axis A. For instance, eccentric weights 144, 146 may have centers of mass 148, 150, respectively.

In the illustrated embodiment, eccentric weights 144, 146 are fixedly mounted on opposing ends of shaft 142. As a result, when shaft 142 is rotated by motor 140, eccentric weights 144, 146 likewise rotate about axis A. For instance, in FIG. 3, eccentric weights 144, 146 are shown in solid lines in a first position. Eccentric weights 144, 146 are also shown in dashed lines in a second position after eccentric weights 144, 146 are rotated partially about axis A. As can be seen, as eccentric weights 144, 146 rotate, centers of mass 148, 150 revolve about axis of rotation A. The movement of centers of mass 148, 150 about axis A causes vibration assembly 134*a* to vibrate. Because vibration assembly 134*a* is mounted to handlebar assembly 112, the vibrations from vibration assembly 134*a* are transferred to handlebar assembly 112, thereby causing handlebar assembly 112 to vibrate. Likewise, the vibrations from vibration assemblies 134*b*-134*d* are transferred to the parts of exercise device 100 to which they are attached (e.g., support member 106 and seat 110, cranks 120 and pedals 122).

The intensity and frequency of the vibrations are a result of a number of different variables, including the speed at which the eccentric weights 144, 146 rotate, the distance between axis A and centers of mass 148, 150, and the size of eccentric weights 144, 146. The intensity and/or frequency of the vibrations can be increased by increasing the rotational speed of eccentric weights 144, 146, increasing the distance between axis A and centers of mass 148, 150, and/or increasing the size of eccentric weights 144, 146. Conversely, the intensity and/or frequency of the vibrations can be decreased by decreasing the rotational speed of eccentric weights 144, 146, decreasing the distance between axis A and centers of mass 148, 150, and/or decreasing the size of eccentric weights 144, 146.

Vibration assemblies 134*a*-134*d* may also be connected to controller 132 and/or control panel 114. For instance, as shown in FIG. 2, vibration assembly 134*a* is connected to controller 132 and/or control panel 114 via wires 152. Connecting vibration assemblies 134*a*-134*d* to controller 132 enables controller 132 to control the operation of vibration assemblies 134*a*-134*d*, including such things as turning vibration assemblies 134*a*-134*d* on and off, controlling the speed at which the eccentric weights are rotated, and which direction the eccentric weights are rotated. Similarly, connecting vibration assemblies 134*a*-134*d* to control panel 114 enables a user of exercise device 100 to selectively control the operation of vibration assemblies 134*a*-134*d* at control panel 114. For instance, a user may activate one or more inputs on control panel 114 to turn one or more of vibration assemblies 134*a*-134*d* on or off, adjust the speed at which the eccentric weights of each vibration assembly are rotated, and/or alter the direction the eccentric weights rotate.

Figure 4:
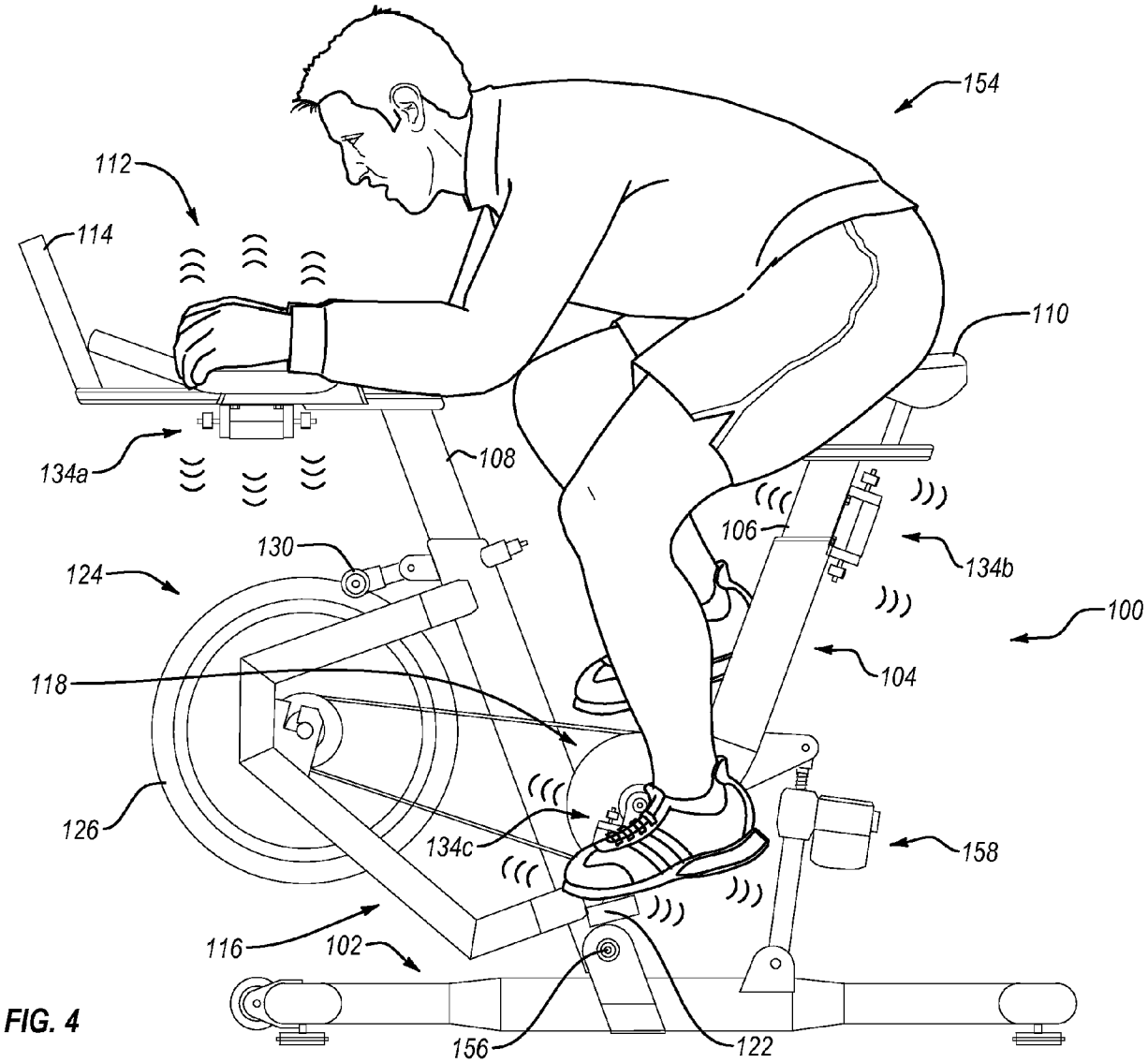
FIG. 4 illustrates a user performing an exercise on the exercise device of FIG. 1.

Attention is now directed to FIG. 4 which illustrates a user 154 exercising on exercise device 100 with the vibration capabilities activated. More specifically, user 154 is riding on exercise device 100 as a person would ride on a traditional bicycle or stationary exercise cycle. As noted, activation of vibration assemblies 134*a*-134*d* causes vibration assemblies 134*a*-134*d* and, in turn, parts of exercise device 100 to vibrate, as illustrated with the vibration lines near vibration assemblies 134*a*-134*d*. As user 154 rides on exercise device 100, the vibrations are transferred to user 154.

As noted, upright support structure 104 is pivotally connected to base support 102. More specifically, upright support structure 104 is pivotally connected to base support 102 at pivot 156, which may allow upright support structure 104 to pivot forward, backward, and/or side-to-side. For instance, as depicted in FIGS. 1 and 4, upright support structure 104 can be oriented in a neutral position. In the neutral position, handlebar assembly 112 and seat 110 may be generally the same vertical distance from the floor or other support surface, although such is illustrative only, and the handlebar assembly 112 and seat 110 may be at different heights, even in the neutral position. When upright support structure 104 is in the neutral position, a user sitting on seat 110 may feel that he or she is sitting on a bicycle that is on a generally level surface.

Figure 5:
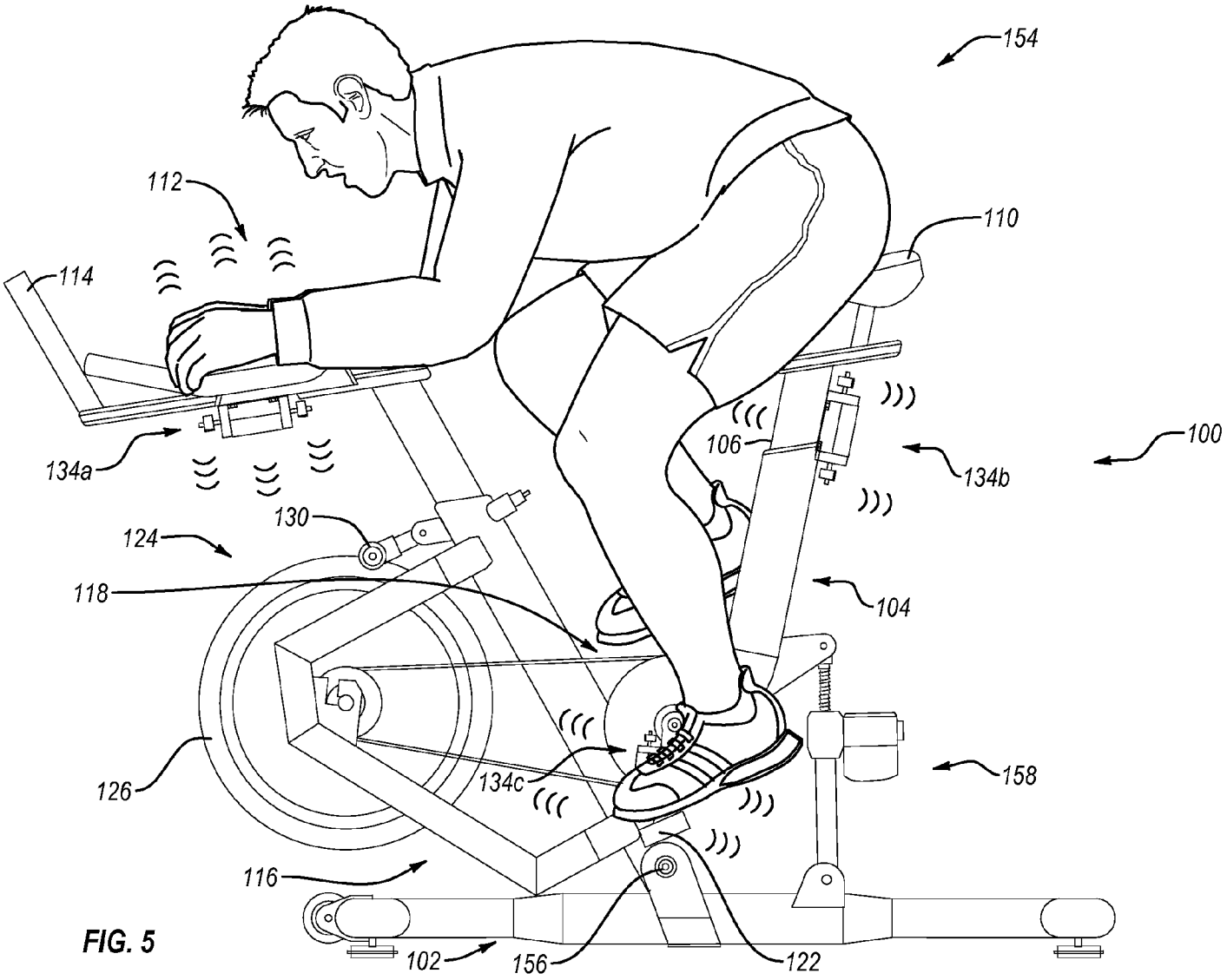
FIG. 5 illustrates a side view of the exercise device of FIG. 1 with an upright frame shown in a forwardly tilted position.

As illustrated in FIG. 5, upright support structure 104 can be oriented in a forwardly tilted position such that handlebar assembly 112 is vertically closer to the floor or other support structure than seat 110 or relative to the position of handlebar assembly 112 in the neutral position. This is achieved by adjusting the vertical pitch of upright support structure 104 relative to a floor or other support surface. Tilting upright support structure 104 forward as illustrated in FIG. 5 enables a user to simulate riding down a hill.

Figure 6:
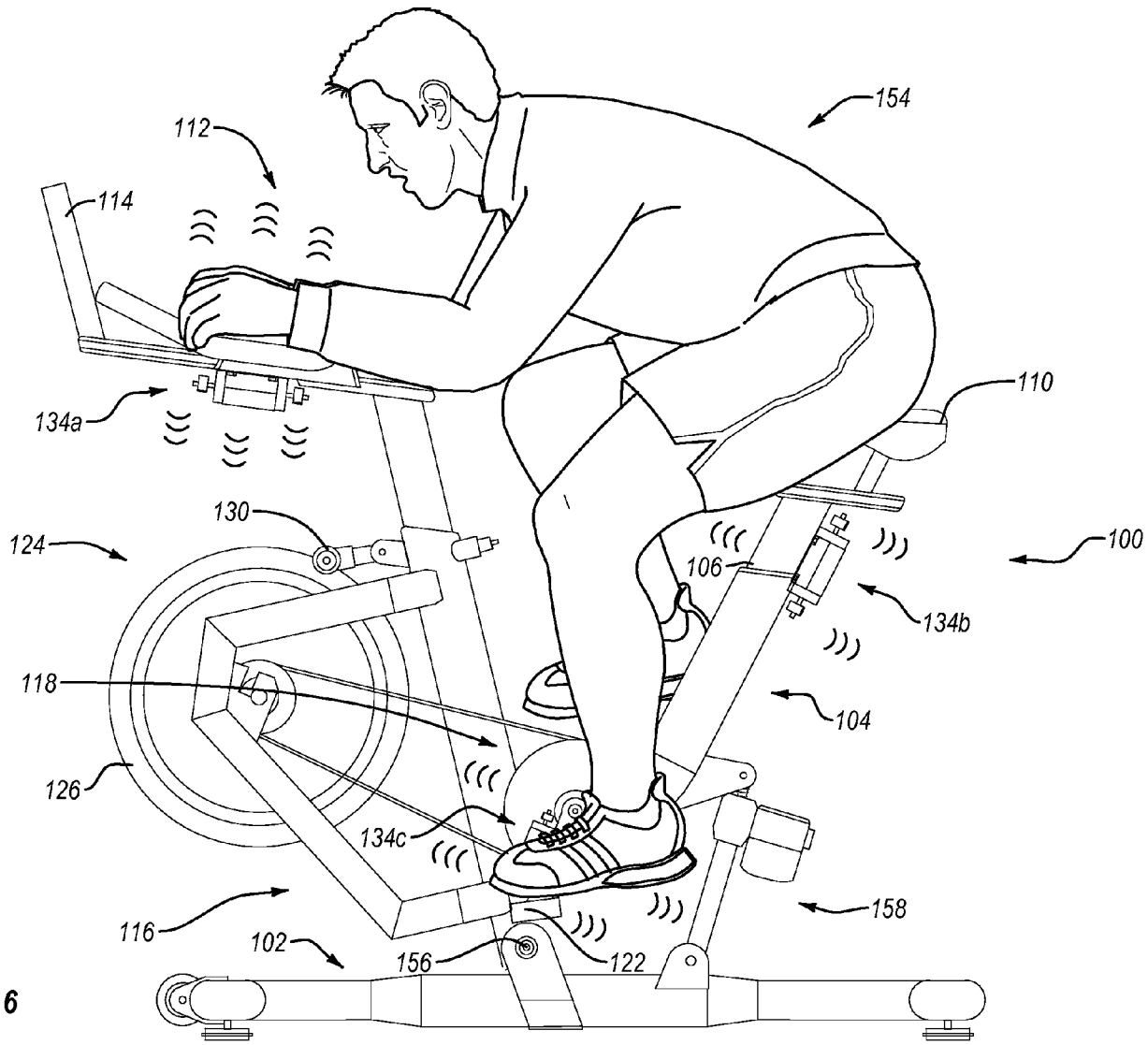
FIG. 6 illustrates a side view of the exercise device of FIG. 1 with an upright frame shown in a rearwardly tilted position.

As illustrated in FIG. 6, upright support structure 104 can also be oriented in a backwardly tilted position in which handlebar assembly 112 is vertically further from the floor or other support structure when compared to seat 110, or when compared to the position of handlebar assembly 112 when upright support structure 104 is in the neutral position. Typical bicycle rides outside involve inclines and declines as well as flat surfaces, each of which can be accommodated and replicated by the tilting ability of upright support structure 104. Thus, exercise device 100 is able to more closely simulate a typical outdoor bicycle ride.

To facilitate the tilting of upright support structure 104 relative to base support 102, an extension mechanism 158, or another linearly extending assembly, may be connected between upright support structure 104 and base support 102, as shown in FIGS. 1 and 4-6. Extension mechanism 158 may extend or retract to tilt upright support structure 104 forward or backward as desired. Extension mechanism 158 may optionally be coupled to controller 132 such that controller 132 controls the operation of extension mechanism 158, and thus the tilt of upright support structure 104 in response to various user inputs at control panel 114 or other control signals.

INDUSTRIAL APPLICABILITY

In general, embodiments of the present disclosure relate to systems and devices that impart vibrations to a user's body.

More particularly, the systems and devices of the present disclosure impart vibrations to a user's body during the performance of an exercise. The exercise and the imparted vibrations can provide numerous benefits to the user, including aerobic conditioning, improved muscle strength and performance, increased bone density, stamina, flexibility, mobility, and coordination, enhanced critical blood flow throughout the body, relief of aches and pains, enhanced explosive strength, accelerated weight loss, decreased cortisol levels, increased production of serotonin and neurothrophine, and improved injury recovery.

The systems and devices of the present disclosure may include an exercise device in the form of a stationary exercise cycle. The exercise cycle may include an upright support structure connected to a base support. The support structure may include a seat, a handlebar assembly, a pedal assembly, and a resistance assembly. The resistance assembly may adjust the amount of resistance applied to, and thus the force required to rotate, the pedal assembly.

Optionally, the support structure may be pivotally connected to the base support to enable the support structure to tilt forward, backward, or side-to-side in order to more realistically simulate an outdoor bicycle ride. One or more extension mechanisms may facilitate tilting of the support structure between neutral, forwardly tilted, rearwardly tilted, and side tilted positions.

The systems and devices of the present disclosure may also include one or more vibration assemblies that create vibrations that are imparted to the user during the performance of the exercise. Each of the one or more vibration assemblies may include a motor, such as a rotary motor, that rotates a shaft about an axis of rotation. The axis of rotation may be generally parallel to or collinear with a longitudinal axis of the shaft. One or more eccentric weights may be mounted on the shaft such that rotation of the shaft causes the one or more eccentric weights to rotate about the axis of rotation. Each of the one or more eccentric weights may have a center of mass that is offset from the axis of rotation. As a result of the offset between the centers of mass and the axis of rotation, rotation of the one or more eccentric weights creates vibrations that are transferred through the exercise device and into the user. In other embodiments, the vibration assembly motor may directly rotate the one or more eccentric weights without requiring the weights to be mounted on a shaft.

The one or more vibration assemblies may be connected to the exercise device such that the vibrations created by the one or more vibration assemblies are transferred to specific parts or the entirety of the exercise device. For instance, the one or more vibration assemblies may be rigidly connected to specific locations on the exercise device. Such locations may include on or near one or more of the handlebar assembly, the seat, the seat post, the seat support member, one or more of the cranks, and one or more of the pedals. Accordingly, one or more vibration assemblies may be connected to the exercise device to vibrate one or more portions of the exercise device. The number of vibration assemblies used may depend on the size of the vibration assemblies used, the placement of the vibration assemblies on the exercise device, and/or the portions of the exercise device that are to be vibrated.

For instance, one relatively large vibration assembly may be connected to the upright support structure. This arrangement may allow for the vibrations to spread through the upright support structure and into the user by way of the handlebar assembly and the seat. Alternatively, one or more vibration assemblies may be connected to the handlebar assembly to vibrate just the handlebar assembly. Similarly, one or more vibration assemblies may be connected to the seat, seat post, or seat support member to vibrate just the seat, the seat post, and/or the seat support member. Likewise, one or more vibration assemblies may be connected to one or both of the cranks and/or one or both of the pedals to vibrate just the cranks and/or pedals. Still further, multiple vibration assemblies may be connected to the exercise device at various locations to vibrate one or more portions of the exercise device.

In cases where multiple vibration assemblies are used, the vibration assemblies may be coordinated with one another to create vibrations with desired characteristics. For instance, the rotational speed and/or direction of the vibration assemblies may be coordinated to create vibrations with desired intensities and/or frequencies. More specifically, the rotational speed and/or direction of each vibration assembly may be controlled to generate the desired vibrations where the user contacts the exercise device. In other words, the rotational speed and/or direction of each vibration assembly may be controlled so that the vibrations from each vibration assembly either add to or partially cancel the vibrations from the other vibration assemblies to achieve the desired vibrations.

In addition or as an alternative to having rotating eccentric weights that create vibrations, the one or more vibration assemblies may include one or more rotating cams or other movable members that periodically engage, hit, or tap the exercise device or components thereof in order to create the vibrations in the exercise device.

In addition to the above-noted physiological benefits, adding vibration to the disclosed devices can increase the enjoyment associated with using the disclosed devices. For instance, a user that rides on a typical stationary exercise cycle may find it uncomfortable or boring to ride on a rigid device. In contrast, vibrating the exercise device can provide a sensation to the user that is similar to riding on a road, trail, or other outdoor surface as well as providing a softer ride for the user.

In some embodiments, the intensity and/or frequency of the vibrations may be tied to other operating parameters of the exercise device. By way of non-limiting example, the intensity and/or frequency of the vibrations may be tied to speed of the pedal assembly, the resistance level of the resistance assembly, and/or the tilt of the upright support structure. For instance, the intensity and/or frequency of the vibrations may increase or decrease as the speed of the pedal assembly increases or decreases. Similarly, the intensity and/or frequency of the vibrations may increase or decrease as the tilt of the upright support structure increases or decreases.

What is claimed is:

1. An exercise cycle, comprising:

a generally upright support structure;

a seat mounted on the generally upright support structure;

a handlebar assembly mounted on the generally upright support structure;

a pedal assembly connected to the generally upright support structure; and one or more vibration assemblies, wherein the one or more vibration assemblies are controlled by a controller to adjust vibrations to cause at least one of the seat, the handlebar assembly, and the pedal assembly to simulate an outdoor trail;

wherein the generally upright support structure is continuously adjustable by the controller during operation between a plurality of tilted positions, including a forwardly tilted position, a neutral position, and a rearwardly tilted position to simulate the outdoor trail; and wherein the one or more vibration assemblies change an intensity or a frequency of the vibrations based on one of the tilted positions of the generally upright support structure.

2. The exercise cycle of claim 1, wherein the one or more vibration assemblies comprise a vibration assembly connected to the handlebar assembly, wherein the vibration assembly selectively vibrates the handlebar assembly.

3. The exercise cycle of claim 1, wherein the one or more vibration assemblies comprise a vibration assembly connected to the generally upright support structure near the seat, wherein the vibration assembly selectively vibrates the seat.

4. The exercise cycle of claim 1, wherein the one or more vibration assemblies comprise a vibration assembly connected to the pedal assembly, wherein the vibration assembly selectively vibrates the pedal assembly.

5. The exercise cycle of claim 1, wherein the pedal assembly comprises a pair of cranks and a pair of pedal connected to the pair of cranks.

6. The exercise cycle of claim 1, wherein at least one of the one or more vibration assemblies comprises a motor, a shaft rotatable by the motor about an axis of rotation, and one or more eccentric weights mounted on the shaft.

7. The exercise cycle of claim 6, wherein each of the one or more eccentric weights comprises a center of mass that is offset from the axis of rotation.

8. The exercise cycle of claim 7, wherein rotation of the shaft about the axis of rotation causes the centers of mass of the one or more eccentric weights to revolve around the axis of rotation, thereby creating the vibrations.

9. The exercise cycle of claim 8, wherein an intensity or frequency of the vibrations is selectively controlled by adjusting the speed at which the centers of mass of the one or more eccentric weights revolve around the axis of rotation.

10. The exercise cycle of claim 1, further comprising a control panel having one or more user inputs, the control panel being in electrical communication with the one or more vibration assemblies such that the one or more vibration assemblies are controllable by activating the one or more user inputs.

11. The exercise cycle of claim 1, wherein an intensity or frequency of the vibrations is related to the speed at which the pedal assembly rotates.

12. The exercise cycle of claim 1, wherein the one or more vibration assemblies comprise a vibration assembly connected to the handlebar assembly, a vibration assembly connected near the seat, and a vibration assembly connected to the pedal assembly.

13. The exercise cycle of claim 1, further comprising a resistance assembly operatively connected to the pedal assembly, wherein the resistance assembly regulates the rotation of the pedal assembly.

14. The exercise cycle of claim 1, wherein the one or more vibration assemblies selectively create vibrations to simulate a riding surface.

15. An exercise cycle, comprising:

a base support;

a generally upright support structure pivotally connected to the base support, wherein the generally upright support structure is movable between a plurality of tilted positions during operation, including a forwardly tilted position, a neutral position, and a rearwardly tilted position that simulates an outdoor ride with a controller;

a seat connected to the generally upright support structure;

a handlebar assembly connected to the generally upright support structure;

a control panel connected to the handlebar assembly;

a pedal assembly connected to the generally upright support structure; and one or more vibration assemblies, wherein the one or more vibration assemblies selectively create vibrations to cause at least one of the seat, the handlebar assembly, and the pedal assembly to vibrate to simulate the outdoor ride with the controller, at least one of the one or more vibration assemblies comprising:

a motor;

a shaft rotatable by the motor about an axis of rotation; and one or more eccentric weights fixedly mounted on the shaft such that rotation of the shaft causes the one or more eccentric weights to rotate about the axis of rotation, each of the one or more eccentric weights having a center of mass that is radially offset from the axis of rotation; and wherein the one or more vibration assemblies change an intensity or frequency of the vibrations created by the one or more vibration assemblies based on one of the plurality of tilted positions of the generally upright support structure.

16. The exercise cycle of claim 15, wherein at least one of the one or more vibration assemblies is connected to the pedal assembly.

17. The exercise cycle of claim 15, wherein the one or more vibration assemblies comprise:

a first vibration assembly connected to the handlebar assembly; and a second vibration assembly connected to the upright support structure near the seat.

18. The exercise cycle of claim 15, further comprising an extension mechanism connected between the base support and the generally upright support structure, wherein the extension mechanism selectively moves the generally upright support structure between the plurality of tilted positions.

* * * * *